US005461850A

United States Patent [19]

Bruyneel et al.

[11] Patent Number: 5,461,850

[45] Date of Patent: Oct. 31, 1995

[54] MULTI-STRAND STEEL CORD HAVING A CORE AND PERIPHERAL STRANDS SURROUNDING THE CORE

[75] Inventors: Pol Bruyneel, Wielsbeke; Luc Bourgois, Desselgem, both of Belgium

[73] Assignee: N.V. Bekaert S.A., Zwevegen, Belgium

[21] Appl. No.: 160,293

[22] Filed: Dec. 2, 1993

[30] Foreign Application Priority Data

Dec. 18, 1992 [EP] European Pat. Off. ..... 92204017

[51] Int. Cl.[6] ..... D02G 3/36; B60C 9/00

[52] U.S. Cl. ..... 57/212; 57/214; 57/218; 57/902

[58] Field of Search ..... 57/902, 212, 213, 57/214, 218; 452/451, 527, 556

[56] References Cited

U.S. PATENT DOCUMENTS

| | | | |
|---|---|---|---|
| 2,567,300 | 9/1951 | Riddle | 57/214 |
| 2,792,868 | 5/1957 | Benson | 57/902 |
| 3,240,570 | 3/1966 | Grimes et al. | 57/214 |
| 3,413,799 | 12/1968 | LeJeune | 57/218 |
| 3,555,789 | 2/1969 | Terragna | 57/218 |
| 3,922,841 | 12/1975 | Katsumata et al. | 57/218 |
| 4,498,282 | 2/1985 | Graetz | 57/218 |
| 4,947,636 | 8/1990 | Sinopoli | 57/902 |
| 4,947,638 | 8/1990 | Nagamine et al. | 57/902 |

FOREIGN PATENT DOCUMENTS

| | | | |
|---|---|---|---|
| 1000162A6 | 6/1988 | Belgium . | |
| 2021888 | 1/1987 | Japan | 57/212 |

OTHER PUBLICATIONS

"Belt Cord Construction", Research Disclosure, No. 297, pp. 7–9, 29712, Emsworth, GB, Jan. 1989.

"Steel Cords of the 1+6+12–type", Research Disclosure, No. 343, pp. 857–859, 34370, Elmsworth, GB, Nov., 1992.

*Primary Examiner*—Daniel P. Stodola
*Assistant Examiner*—William Stryjewski
*Attorney, Agent, or Firm*—Foley & Lardner

[57] ABSTRACT

A steel cord (10) has a diameter D and includes a core strand (12) and up to nine peripheral strands (14) surrounding the core strand. The core strand (12) has a diameter D1 and the peripheral strands (14) have a diameter D2. The ratio core strand diameter to peripheral strand diameter D1/D2 is greater than a predetermined value in order to enable rubber penetration. Each strand has a center of one or more center filaments (16, 22) and two or more layers of filaments (18, 20, 24, 26) surrounding the center. The twist angle of a radially outer layer is smaller than the twist angle of a radially inner layer of the same strand. A first free space (28) ranging from 0.0015×D to 0.0075×D is provided in at least the core strand between each pair of filaments (18) of the radially most inner layer.

29 Claims, 4 Drawing Sheets

MULTI-STRAND STEEL CORD HAVING A CORE AND PERIPHERAL STRANDS SURROUNDING THE CORE

FIELD OF THE INVENTION

The invention relates to a steel cord having a core strand and up to nine peripheral strands surrounding the core. Each strand comprises a center of one or more center filaments and two or more layers of filaments surrounding the center. Such a steel cord is often called a multi-strand steel cord.

A multi-strand steel cord may be used as a reinforcement of rubber products such as conveyor belts and heavy tires for off-the-road applications. Such a multi-strand steel cord may also be used as a hoisting cable or rope for applications in mines or elevators. Therefore, in what follows, no distinction will be made between the terms steel "cords", steel "ropes" and steel "cables".

A multi-strand steel cord is composed of high-carbon steel filaments of a suitable rod composition allowing high breaking loads to be reached. The steel filaments may be provided with a corrosion resistive coating such as a zinc or a zinc alloy or with a rubber adherable coating such as a copper alloy.

BACKGROUND OF THE INVENTION

Multi-strand steel cords must have a durable resistance to corrosion with a view to increasing their life span. Corrosion attack of the cords can be avoided not only by providing a suitable coating such as zinc but also by proper constructional features which allow rubber to penetrate between the individual steel filaments in the cord. Rubber penetration can be obtained by providing free spaces between the individual filaments. The situation with multi-strand steel cords is, however, not that simple as is the case with single-strand steel cords for the reinforcement of passenger or truck tires. A typical example of a multi-strand steel cord is a 7×19-construction. This steel cord has 133 individual steel filaments. Protecting every filament against corrosion attack means that every filament, even the center filaments of the core strand, should be enveloped with a rubber layer. As a consequence, relatively large spaces must be provided between neighbouring filaments. When providing large spaces between the filaments, however, the strands building up the cord and/or the cord structure itself loose their compact and uniform geometrical shape during embedment and, as a consequence, the cord no longer offers a uniform reinforcing level along its length. Moreover, it is always required that a certain given reinforcement level is achieved with the smallest possible volume of reinforcing material. This means that for a predetermined breaking load, the cross-sectional area of the steel cord should be as small as possible, which means that the outer diameter of each cord should be choosen as small as possible for a given steel section. It goes without saying that this requirement contravenes the above stated aim of providing relatively large spaces between neighbouring filaments in the cord.

SUMMARY OF THE INVENTION

It is an object of the invention to provide a multi-strand steel cord with a adequate rubber penetration coupled with a maximum reinforcement degree.

According to a first aspect and to a first embodiment of the present invention, there is provided a steel cord having a diameter D and comprising a core strand and up to six peripheral strands which surround the core strand. The core strand has a diameter D1 and the peripheral strands have a diameter D2.

The ratio core strand diameter to peripheral strand diameter D1/D2 is greater than 1.05 and preferably smaller than 1.30. If D1/D2 is smaller than 1.05, an insufficient amount of rubber is able to penetrate between the peripheral strands to the core strand. If D1/D2 is greater than 1.30, a less uniform cross-section is obtained along the cord length.

Each strand comprises a center of one or more center filaments and two or more layers of filaments surrounding the center. All the filaments of each layer have substantially the same diameter. The filament diameter in each layer is preferably smaller than the total diameter of the center of the same strand. The filament diameter in a radially outer layer is also preferably smaller than the filament diameter in a radially inner layer of the same strand.

The twist angle of a radially outer layer is smaller than the twist angle of a radially inner layer of the same strand. The twist angle of a layer is within the context of this invention defined as follows. Suppose that $d_1$ is the (total) diameter of the center, that $d_2$ is the diameter of the filaments of the radially inner layer which immediately surrounds the center and that $d_3$ is the diameter of the filaments of a second layer surrounding the radially inner layer (=radially outer layer).

$LL_2$ is the lay length of the radially inner layer and $LL_3$ is the lay length of the radially outer layer.

The twist angle of the radially inner layer is defined as:

$$\alpha_2 = arctg[(d_1+d_2)\times\pi/LL_2]\times 180/\pi$$

The twist angle of the second layer is defined as:

$$\alpha_3 = arctg[(d_1+d_2+d_3)\times\pi/LL_3]\times 180/\pi$$

In case more than two layers surround the center structure, similar formulas can be used to determine the twist angle of a third and, possibly, a fourth layer.

Preferably, the difference in twist angle between a layer and an immediately underlying layer (=immediately radially inner layer) ranges between 1.5% and 20% of the twist angle of the immediately underlying layer, and most preferably this difference in twist angle is up to 10% of the twist angle of the immediately underlying layer. This arrangement of twist angles offers the advantage that filaments of an immediately radially outer layer do not tend to penetrate into the superficial helicoidally disposed interstices at the surface of the immediately radially inner layer, thereby blocking these interstices and preventing rubber penetration. Moreover, the arrangement of twist angles helps the formation of layers which are almost perfectly cylindrical in shape. The application of the larger angle in the radially inner layers also compensates for the inherently shorter filament lengths of the radially inner layers in comparison with the filaments in the radially outer layers. In this sense the arrangement of twist angles contributes to a regular distribution of the loading forces over all the filaments in the overall cross-section of the steel cord.

A first free space ranging from 0.0015×D to 0.0075×D, and preferably from 0.002×D to 0.007×D, is provided in at least the core strand between each pair of filaments of the radially most inner layer in order to enable the rubber to penetrate to the center filaments. Suitable absolute values of this first free space range from 0.010 mm to 0.075 mm. If the first free space has a value below the ranges mentioned, the chance for insufficient rubber penetration is great. If the first free space has a value above the ranges mentioned, too much volume will be occupied by the steel cord for a same predetermined breaking load.

A second free space being greater than the first free space, preferably ranging from 0.003×D to 0.015×D, and most preferably from 0.004×D to 0.012×D is provided in at least the core strand between each pair of filaments of the layer(s) surrounding the radially most inner layer. Suitable absolute values of this second free space range from 0.030 mm to 0.150 mm. The second free space must be greater than the first free space, since the second free space must not only allow the penetration of rubber in the layer(s) surrounding the radially most inner layer, but also the penetration of the rubber for the radially most inner layer and for the center. If the second free space has a value below the ranges mentioned, the chance for insufficient rubber penetration is great. If the second free space has a value above the ranges mentioned, too much volume will be occupied by the steel cord for a same predetermined breaking load.

The peripheral strands preferably have a preforming ratio ranging from 90% to 105%, e.g. from 93% to 100%. A preforming ratio of 97% is a good value.

The preforming ratio of the peripheral strands can be measured as follows. A predetermined length (e.g. 500 mm) of an assembled steel cord is taken and measured exactly. Next the peripheral strands are disentangled from the steel cord without plastically deforming the strands. The preforming ratio is determined as:

$$\text{preforming ratio (\%)} = \frac{\text{length of steel cord}}{\text{length of the disentangled strand}} \times 100$$

All the layers of the core strand are preferably twisted in a first direction. The peripheral strands are preferably twisted around the core strand in this first direction, while the layers of the peripheral strands are twisted in a direction opposite to this first direction. This is done in order to promote a stable torsion balance.

The multi-strand cord according to the present invention may have following center structures:

(1) a single center filament;

(2) three filaments twisted around a straight, thin auxiliary filament which does not necessarily contribute to the final strength of the overall cord;

(3) two to seven filaments twisted with a twist angle which is greater than the twist angle of the overlying layer.

The diameter of the cord ranges from 3 to 20 mm, e.g. from 6 to 15 mm. The diameter of the steel filaments ranges from 0.15 to 1.20 mm.

The steel filaments may be provided with a copper alloy coating if adhesion to the rubber is a dominant factor, or with zinc or a zinc alloy coating if resistance to corrosion is a dominant factor.

Other embodiments of the first aspect of the present invention are as follows.

Up to five peripheral strands can be provided with a diameter D1/D2 ratio of at least 0.70, but with a maximum of 0.92.

Up to seven peripheral strands can be provided in the steel cord according to the invention with a diameter D1/D2 ratio of at least 1.39, but with a maximum of 1.69.

Up to eight peripheral strands can be provided with a diameter D1/D2 ratio of at least 1.73, but with a maximum of 2.10.

Up to nine peripheral strands can be provided with a diameter D1/D2 ratio of at least 2.07, but with a maximum of 2.45.

According to a second aspect of the present invention, there is provided a rubber product comprising at least one multi-strand steel cord according to the first aspect of the present invention. Rubber penetrates to the center filaments of the core strand and preferably envelops all the center filaments of the core strand. In this way a cord is obtained where all the individual steel filaments of the whole cord are surrounded by rubber.

The rubber product may be a conveyor belt or a tire for off-the-road applications.

According to a particular aspect of the invention, however, the rubber product is an elongated element with a substantially round cross-section and comprising only one multi-strand steel cord. The kind of rubber to be used depends on the eventual application. The rubber compound can be a suitable polychloroprene rubber having a fire resistance. The rubber compound can also be a nitrile rubber for freeze prevention and oil resistance or an EPDM rubber, i.e., an ethylene-propylene terpolymer, for an adequate weakening resistance and a low friction.

BRIEF DESCRIPTION OF THE DRAWINGS

The invention will now be explained in more detail with reference to the accompanying figures wherein.

DETAILED DESCRIPTION OF PREFERRED EMBODIMENTS

Figure 1:
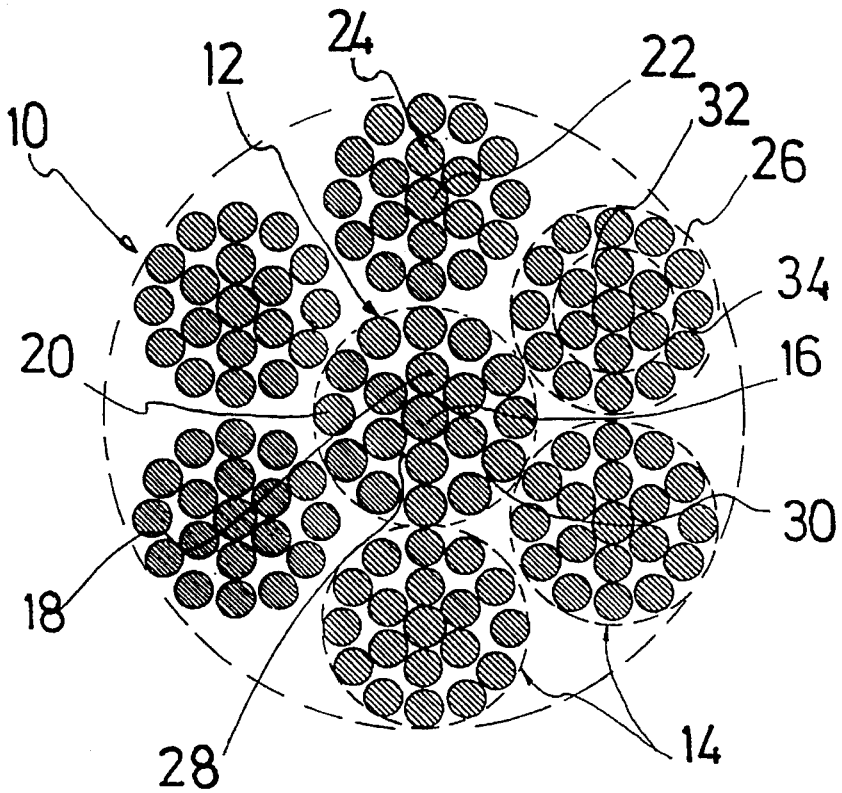
FIG. 1 shows schematically a cross-section of a multi-strand steel cord according to a first embodiment of the invention.

Referring to FIG. 1, a multi-strand steel cord 10 according to the first embodiment of the invention comprises a core strand 12 and six peripheral strands 14 which surround the core strand 12.

The core strand 12 comprises a center filament 16 surrounded by a radially inner layer of six steel filaments 18 and by a radially outer layer of twelve steel filaments 20. The diameter of center filament 16 is greater than the diameter of filament 18 and the diameter of filament 18 is greater than the diameter of filament 20.

Each peripheral strand 14 comprises a center filament 22 surrounded by a radially inner layer of six steel filaments 24 and by a radially outer layer of twelve steel filaments 26. The diameter of center filaments 22 is greater than the diameter of steel filaments 24 and the diameter of steel filaments 24 is greater than the diameter of steel filaments 26.

In this way a so-called 7×19 multi-strand steel cord is obtained.

A first free space 28 is provided between neigbouring filaments 18 of the radially inner layer of the core strand 12. Such a first free space 32 may also be provided between neighbouring filaments 24 of the peripheral strands 14.

A second free space 30 is provided between neighbouring filaments 20 of the radially outer layer of the core strand 12. Such a second free space 34 may also be provided between neighbouring filaments 26 of the radially outer layer of the peripheral strands 14.

Multi-strand steel cord 10 can be manufactured according to following well known process steps:

- a conventional drawing process, if necessary combined with the proper number of intermediate patenting steps;
- a conventional galvanising process;
- a conventional twisting process, e.g. by twisting first the individual strands followed by twisting the strands into the cord, this twisting can be done by means of a conventional tubular twisting machine or by means of a well-known double-twisting machine; the required degree of preforming of the peripheral strands may be obtained by subjecting the peripheral strands to a bending operation under a tensile force just before twisting.

Depending upon the choice of the wire rod and of the applied thermo-mechanical treatments, different levels of tensile strengths can be obtained for the different steel filaments of the steel cord. As a general rule, however, it can be stated that all filaments with the same diameter and which occupy the a similar place in the cord, have about the same tensile strength.

Figure 2:
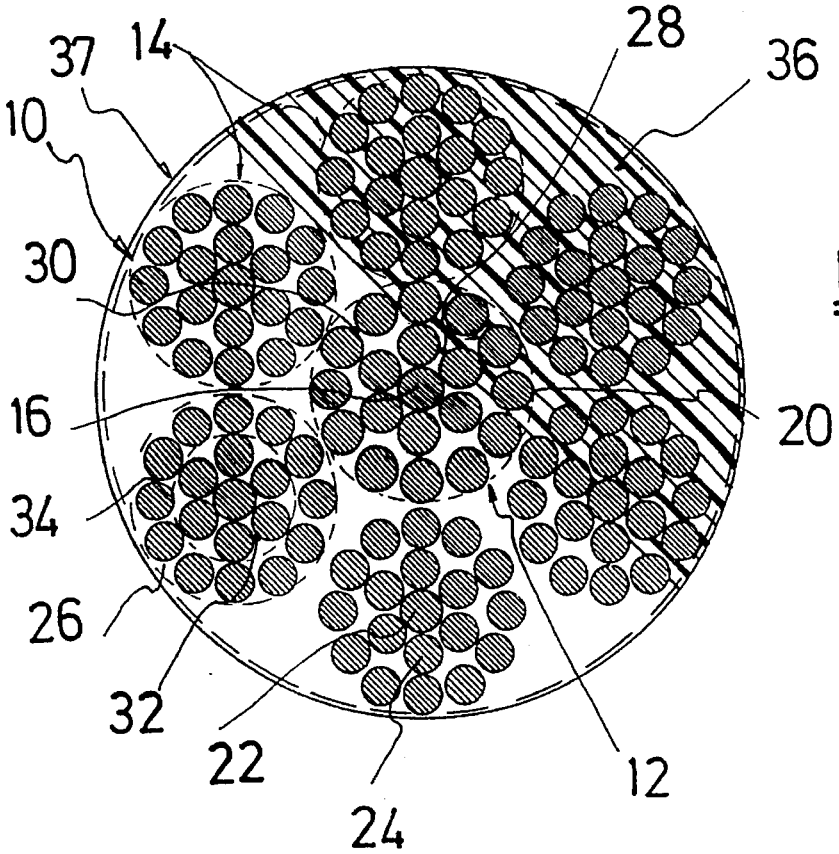
FIG. 2 shows schematically a cross-section of a rubber product comprising a multi-strand steel cord.

FIG. 2 shows the cross-section of an elongated rubber product which comprises a multi-strand steel cord 10 as described hereabove. Rubber 36 penetrates to every steel filament, even to center filament 16 of core strand 12. The circumferential circle of the cross-section of steel cord 10 is covered with a thin ply of rubber 36 so that an elongated element with a round cross-section is obtained.

As may noticed from FIG. 2, spaces are provided around almost every individual steel filament allowing rubber 36 to envelop almost every individual steel filament. This means that steel-to-steel contacts are practically excluded. In other words, fretting between steel filaments mutually is strongly reduced, which enhances the fatigue resistance of the composite rubber-cord, this will be illustrated below by way of an example.

A rubberised cord as shown in FIG. 2 can be used as a hoisting cable in mines or elevators, and particularly in those applications where a high resistance to corrosion and a high resistance to fatigue are required.

Figure 3:
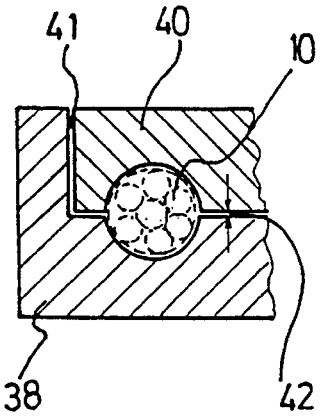
FIG. 3 illustrates the process of vulcanising a multi-strand steel cord.

The elongated rubberised cord of FIG. 2 can be manufactured by a vulcanisation process which is illustrated in FIG. 3. A mould comprising an under part 38 and an upper part 40 gives the element its round form. A space 41 is provided as a passage for the rubber. A space 42 should be provided between the under part 38 and the upper part 40 in order to avoid that the upper part 40 contacts the lower part 38 and to create the required pressure. Rubber is applied to the cord 10 under a pressure of at least 30 kg/cm$^2$ at a temperature between 140° and 160° C.

Example 1

A 7×19 steel cord 10 according to the invention was built as follows:

cord diameter D is 9.83 mm core strand 12: 0.85 mm (center filament 16)

(S-lay) +6×0.75 mm (filaments 18), twist angle 16.47° +12×0.69 mm (filaments 20), twist angle 16.14° six peripheral strands 14: 0.69 mm (filaments 22)

(Z-lay) +6×0.61 mm (filaments 24), twist angle 11° +12×0.57 mm (filaments 26), twist angle 10.5° cord: twist angle 17.88°, i.e. lay length of 66 mm, S-lay

The first space 28 of the core strand 12 amounts to 0.0259 mm and the second space 30 of the core strand amounts to 0.0706 mm. The ratio D1/D2 is 1.222. The weight of the cord per m is 323.8 g and the filling degree, i.e. the ratio surface of the steel section versus surface of the circumscribing circle corresponds to 54.4%.

This 7×19 steel cord according to the invention has been compared with a reference cord which does not have all features discussed above. The characteristics of the reference cord are as follows:

cord diameter D is 10.03 mm core strand 12: 0.87 mm (S-lay) +6×0.74 mm, twist angle 17.54° +12×0.71 mm, twist angle 21.82° six peripheral strands 14: 0.71 mm (Z-lay) +6×0.63 mm, twist angle 13.9° +12×0.58 mm, twist angle 14.95° cord: lay length of 63 mm, S-lay

The first space in the core strand amounts to 0.038 mm and the second space in the core strand amounts to 0.0308 mm. The ratio D1/D2 is 1.204, the weight of the cord per m is 345.2 g and the filling degree corresponds to 52.8%.

Figure 4:
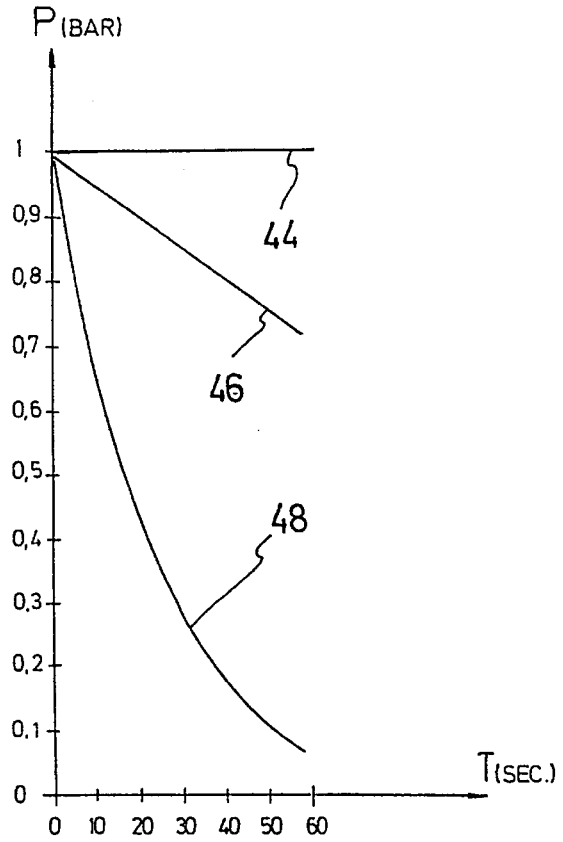
FIG. 4 is a graph representing the rubber penetration in different cord structures.

As illustrated in FIG. 4, discussed hereafter, and despite a greater filling degree, the invention cord offers a much better rubber penetration than the reference cord.

A method and an instrument for measuring rubber penetration have been described in Belgian patent No. 1000162 (A6) of Applicant. Measuring results obtained with this method and instrument are shown in FIG. 4.

The pressure drop in function of the time for the invention cord 10 is represented by curve 44 and is in fact nihil for two different rubber compounds. This means that the spaces between the cord filaments are filled up completely.

In contradistinction herewith, the pressure drop is considerable for the reference cord, as is shown by curve 46 for a first rubber compound and even more clearly by curve 48 for a second rubber compound. This indicates the presence of cavities running along the helicoidal interstices between the filaments through which the air can pass thereby causing a substantial pressure drop. The above results are confirmed when examining the rubber penetration visually after cutting the cords out of the belt section. The different strands are untwisted from both the invention cord and the reference cord, and the filaments of each strands are also untwisted subsequently. Visual inspection of the invention cord allows to notice a substantial degree of rubber coverage even on the center filaments 16 and 22; this is not the case for the reference cord.

Example 2

An invention cord 10 is made as follows:

cord diameter D is 3.20 mm core strand 12: 0.29 mm (center filament 16)

(S-lay) +6×0.26 mm (filaments 18), lay length 6 mm+12×0.24 mm (filaments 20), lay length 12 mm six peripheral strands 14: 0.24 mm (filaments 22)

Figure 5:
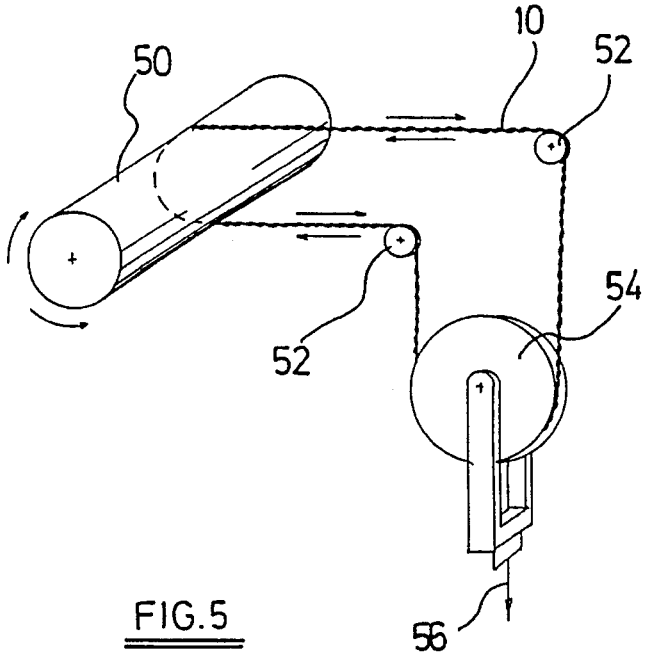
FIG. 5 shows a test configuration for carrying out dynamic tests on cords or belts.

(Z-lay) +6×0.21 mm (filaments 24), lay length 7.5 mm+12×0.20 mm (filaments 26), lay length 15 mm cord: lay length of 23 mm, S-lay The naked (i.e. non rubberised) invention cord 10 and the cord after having been rubberised, i.e. vulcanised into a round elongated element 37, are now subjected to a test which is called the dynamic RPK test and which is illustrated in FIG. 5. The cord 10 or the round element 37 forms a closed circle around a driving drum 50, two fixed guiding rolls 52 and a roll 54. The driving drum 50 continuously changes its direction of rotation with a frequency of 120 changes per minute. A weight 56 of 1000N is attached to roll 54. The number of cycles before fracture is measured.

For the naked invention cord 80,000 cycles are measured before the first filaments break and 355,000 cycles are measured before the complete cord 10 breaks.

For the round elongated element 2,000,000 cycles are measured without noticing filament fractures and without noticing any drop in the residual breaking load.

This test confirms the above statements that rubber which envelops almost every individual steel filament along the entire length of the cord avoids the steel-to-steel contacts and considerably reduces the degree of fretting between the steel filaments, which results in an increased resistance against fatigue.

Figure 6:
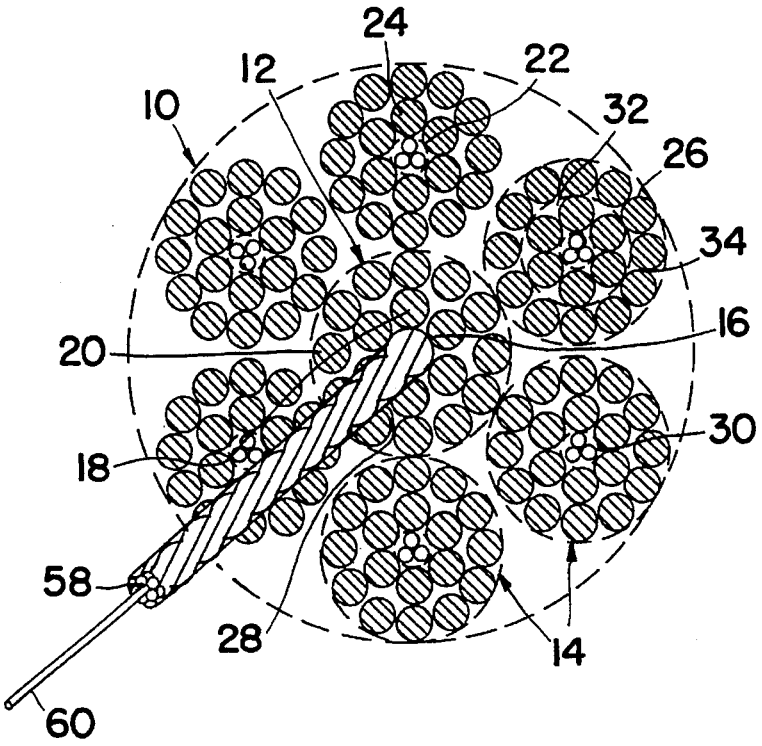
FIG. 6 shows schematically a cross-section of a multiple-strand steel cord according to a second embodiment of the invention.

FIG. 6 shows a multi-strand steel cord 10 according to a second embodiment of the invention. The multi-strand steel cord includes the same features as the first embodiment, however, the center of each strand comprises three twisted filaments 58 enclosing a straight auxiliary filament 60.

Figure 7:
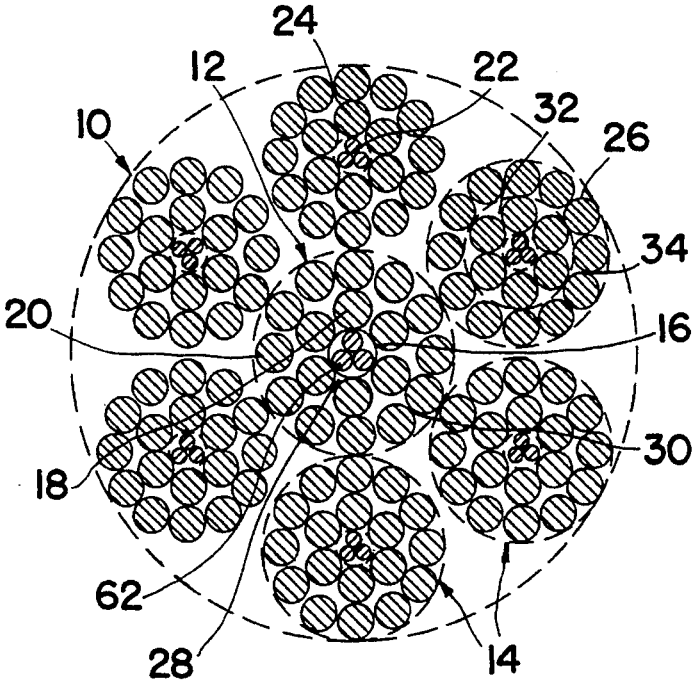
FIG. 7 shows schematically a cross-section of a multiple-strand steel cord according to a third embodiment of the invention.

FIG. 7 schematically shows a cross-sectional view of a third embodiment of the multi-strand steel cord according to the present invention. The multi-strand steel cord 10 also comprises a core strand 12 and six peripheral strands 14 in a similar manner as the first embodiment of the invention shown in FIG. 1, however, the center of each strand comprises two to seven twisted filaments. In FIG. 7 the center comprises three twisted filaments 62.

Figure 8:
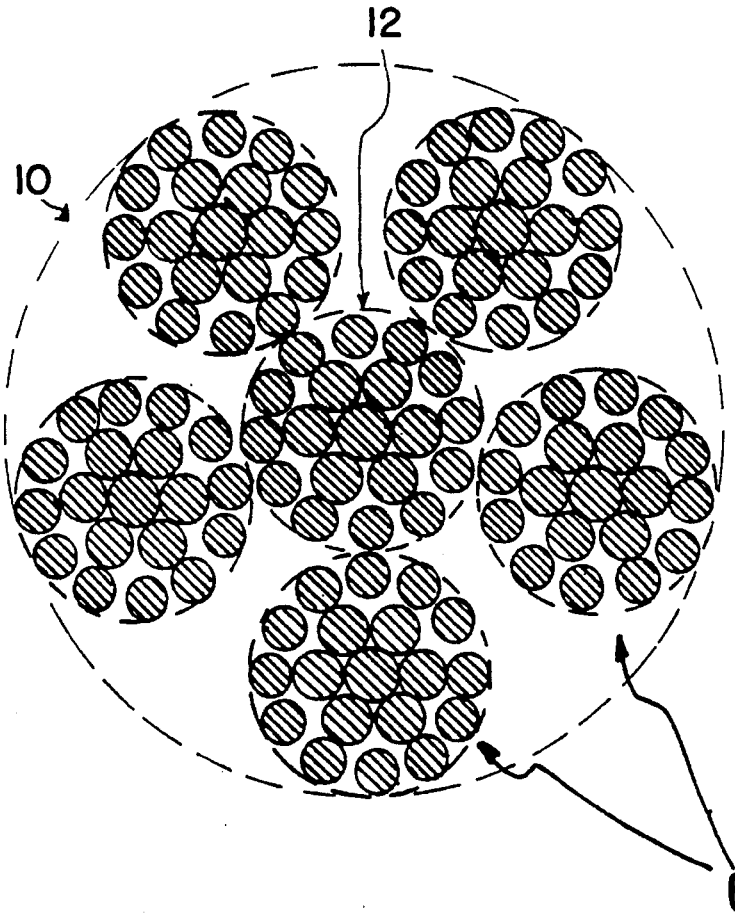
FIG. 8 shows schematically a cross-section of a multi-strand steel cord according to a fourth embodiment of the invention.

FIG. 8 shows a fourth embodiment of the invention. The fourth embodiment provides a multi-strand steel cord 10 with a core strand 12 and up to five peripheral strands 64.

Figure 9:
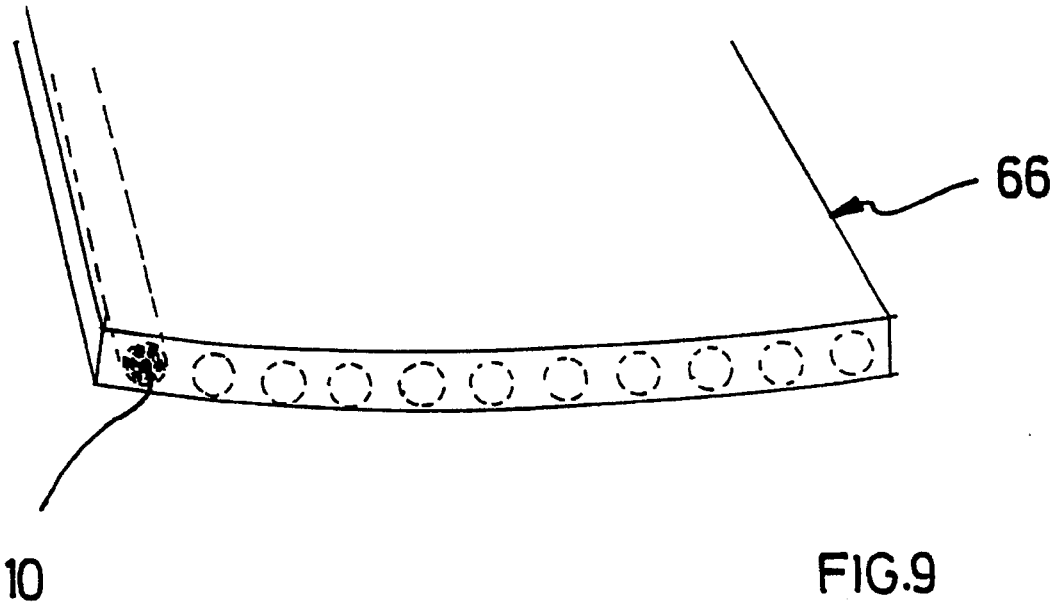
FIG. 9 shows schematically a cross-section of a conveyor belt comprising a multi-strand steel cord.

FIG. 9 shows a schematic cross-sectional view of a conveyor belt 66 including a multi-strand steel cord 10 in accordance with the present invention.

We claim:

1. A steel cord having a diameter D and comprising a core strand and up to six peripheral strands surrounding the core strand, the core strand having a diameter D1 and the peripheral strands having a diameter D2, a ratio of the core strand diameter to the peripheral strand diameter D1/D2 being greater than 1.05, each strand comprising a center of one or more center filaments and two or more layers of filaments surrounding the center, all the filaments of each layer having substantially the same diameter, a radially outer layer having a twist angle which is smaller than a twist angle of a radially inner layer of the same strand, the twist angle of each layer being determined by the diameters and a lay length of the filaments, a first free space ranging from 0.0015×D to 0.0075×D being provided in at least the core strand between each pair of filaments of the radially most inner layer.

2. A steel cord according to claim 1 wherein the peripheral strands have a preforming ratio ranging from 90% to 105%.

3. A steel cord according to claim 1 wherein the ratio core strand diameter to peripheral strand diameter D1/D2 is smaller than 1.30.

4. A steel cord according to claim 1 wherein the first free space ranges from 0.002×D to 0.007×D.

5. A steel cord according to claim 1 wherein a second free space being greater than the first free space is provided in at least the core strand between each pair of filaments of the layer(s) surrounding the radially most inner layer.

6. A steel cord according to claim 5 wherein the second free space ranges from 0.003×D to 0.015×D.

7. A steel cord according to claim 5 wherein the second free space ranges from 0.030 mm to 0.150 mm.

8. A steel cord according to claim 1 wherein the first free space ranges from 0.010 mm to 0.075 mm.

9. A steel cord according to claim 1 wherein the difference in twist angle between a radially outer layer and a radially inner layer ranges between 1.5% and 20% of the twist angle of the radially inner layer.

10. A steel cord according to claim 9 wherein the difference in twist angle between a radially outer layer and a radially inner layer is up to 10% of the twist angle of the radially inner layer.

11. A steel cord according to claim 1 wherein all the layers of the core strand are twisted in a first direction, the peripheral strands being twisted around the core strand in said first direction, the layers of the peripheral strands being twisted in a direction opposite to the first direction.

12. A steel cord according to claim 1 wherein the number of center filaments is one.

13. A steel cord according to claim 1 wherein the center comprises three twisted filaments enclosing a straight auxiliary filament.

14. A steel cord according to claim 1 wherein the center of at least the core strand comprises two to seven filaments being twisted with a twist angle which is greater than a the twist angle of the overlying layer.

15. A steel cord according to claim 1 wherein the diameter D of the cord ranges between 3 and 20 mm.

16. A steel cord according to claim 15 wherein the diameter D of the cord ranges between 6 and 15 mm.

17. A steel cord according to claim 1 wherein the diameter of the filaments ranges from 0.15 mm to 1.20 mm.

18. A steel cord according to claim 1 wherein the filaments are provided with a coating of zinc or a zinc alloy.

19. A rubber product according to claim 1, wherein rubber envelops all the center filaments of the core strand.

20. A steel cord having a diameter D and comprising a core strand and up to five peripheral strands surrounding the core strand, the core strand having a diameter D1 and the peripheral strands having a diameter D2, a ratio of the core strand diameter to the peripheral strand diameter D1/D2 being greater than 0.70, each strand comprising a center of one or more center filaments and two or more layers of filaments surrounding the center, all the filaments of each layer having substantially the same diameter, the filament diameter in each layer being smaller than a total diameter of the center of the same strand, the filament diameter in a radially outer layer being smaller than the filament diameter in a radially inner layer of the same strand, a twist angle of a radially outer layer being smaller than a twist angle of a radially inner layer of the same strand, the twist angle of each layer being determined by the diameters and a lay length of the filaments, a first free space ranging from 0.0015×D to 0.0075×D being provided in at least the core strand between each pair of filaments of the radially most inner layer.

21. A steel cord having a diameter D and comprising a core strand and up to seven peripheral strands surrounding the core strand, the core strand having a diameter D1 and the peripheral strands having a diameter D2, a ratio of the core strand diameter to the peripheral strand diameter D1/D2 being greater than 1.39, each strand comprising a center of one or more center filaments and two or more layers of filaments surrounding the center, all the filaments of each layer having substantially the same diameter, a twist angle of a radially outer layer being smaller than a twist angle of a radially inner layer of the same strand, the twist angle of each layer being determined by the diameters and a lay length of the filaments, a first free space ranging from 0.0015×D to 0.0075×D being provided in at least the core strand between each pair of filaments of the radially most inner layer.

22. A steel cord having a diameter D and comprising a core strand and up to eight peripheral strands surrounding the core strand, the core strand having a diameter D1 and the peripheral strands having a diameter D2, a ratio of the core strand diameter to the peripheral strand diameter D1/D2 being greater than 1.73, each strand comprising a center of one or more center filaments and two or more layers of filaments surrounding the center, all the filaments of each layer having substantially the same diameter, a twist angle of a radially outer layer being smaller than a twist angle of a radially inner layer of the same strand, the twist angle of each layer being determined by the diameters and a lay length of the filaments, a first free space ranging from 0.0015×D to 0.0075×D being provided in at least the core strand between each pair of filaments of the radially most inner layer.

23. A steel cord having a diameter D and comprising a core strand and up to nine peripheral strands surrounding the core strand, the core strand having a diameter D1 and the peripheral strands having a diameter D2, the a ratio of the core strand diameter to the peripheral strand diameter D1/D2 being greater than 2.07, each strand comprising a center of one or more center filaments and two or more layers of filaments surrounding the center, all the filaments of each layer having substantially the same diameter, a twist angle of a radially outer layer being smaller than a twist angle of a radially inner layer of the same strand, the twist angle of each layer being determined by the diameters and a lay length of the filaments, a first free space ranging from 0.0015×D to 0.0075×D being provided in at least the core strand between each pair of filaments of the radially most inner layer.

24. A rubber product according to claim 23 wherein the rubber has penetrated to the center filaments of the core strand.

25. A rubber product according to claim 23 wherein said rubber product is a conveyor belt.

26. A rubber product according to claim 25 wherein the rubber is a polychloroprene rubber.

27. A rubber product according to claim 25 wherein the rubber is a nitrile rubber.

28. A rubber product according to claim 25 wherein the rubber is an EPDM rubber, which is an ethylene-propylene terpolymer.

29. A rubber product according to claim 23 wherein the number of cords is one and the rubber product is an elongated element having a round cross-section.

* * * * *

UNITED STATES PATENT AND TRADEMARK OFFICE

CERTIFICATE OF CORRECTION

PATENT NO. : 5,461,850

DATED : October 31, 1995

INVENTOR(S) : Pol BRUYNEEL et al

It is certified that error appears in the above-identified patent and that said Letters Patent is hereby corrected as shown below:

Column 2, line 34, contains a mathematics error wherein "$\alpha_3$=arctg[($d_1$+$d_2$+$d_3$)x$\pi$/L$L_3$]x180/$\pi$" should read --$\alpha_3$=arctg[($d_1$+2x$d_2$+$d_3$)x$\pi$/L$L_3$]x180/$\pi$--.

Signed and Sealed this

Ninth Day of February, 1999

*Attest:*

*Acting Commissioner of Patents and Trademarks*

*Attesting Officer*